US008256393B2

(12) United States Patent
Simpson et al.

(10) Patent No.: US 8,256,393 B2
(45) Date of Patent: Sep. 4, 2012

(54) VARIABLE CAM TIMING CONTROLS MOUNTED IN THE CAMSHAFT

(75) Inventors: Roger T. Simpson, Ithaca, NY (US); Roger P. Butterfield, Trumansburg, NY (US); Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 289 days.

(21) Appl. No.: 12/664,410

(22) PCT Filed: Jun. 30, 2008

(86) PCT No.: PCT/US2008/068715

§ 371 (c)(1),
(2), (4) Date: Apr. 1, 2010

(87) PCT Pub. No.: WO2009/009328

PCT Pub. Date: Jan. 15, 2009

(65) Prior Publication Data

US 2010/0186699 A1 Jul. 29, 2010

Related U.S. Application Data

(60) Provisional application No. 60/948,219, filed on Jul. 6, 2007.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS

| | | | |
|---|---|---|---|
| 4,354,460 | A | 10/1982 | Mae et al. |
| 5,067,450 | A | 11/1991 | Kano et al. |
| 5,201,289 | A | 4/1993 | Imai |
| 6,435,154 | B1 | 8/2002 | Simpson et al. |
| 6,516,763 | B1 | 2/2003 | Strauss |
| 6,571,757 | B1 | 6/2003 | Simpson |
| 6,792,904 | B2 | 9/2004 | Berglund |
| 6,883,481 | B2 | 4/2005 | Gardner et al. |
| 6,904,880 | B2 | 6/2005 | Green et al. |
| 2002/0023604 | A1 | 2/2002 | Nohara |

FOREIGN PATENT DOCUMENTS

| | | | |
|---|---|---|---|
| JP | 04-093108 | | 3/1992 |
| KR | 2004022854 | A * | 3/2004 |

OTHER PUBLICATIONS

Abstract of KR 2004/022854 given above; Mar. 2004.*

* cited by examiner

*Primary Examiner* — Zelalem Eshete
(74) *Attorney, Agent, or Firm* — Brown & Michaels, PC

(57) ABSTRACT

An internal combustion engine in which the variable cam timing controls for a variable cam timing mechanism include a variable force solenoid mounted within a hollow portion of the camshaft. The variable force solenoid is maintained in place within the hollow camshaft by a tubular shaft fixed to the engine and a bearing between the solenoid and the variable cam timing mechanism.

6 Claims, 3 Drawing Sheets

VARIABLE CAM TIMING CONTROLS MOUNTED IN THE CAMSHAFT

REFERENCE TO RELATED APPLICATIONS

This application claims an invention which was disclosed in Provisional Application No. 60/948,219, filed Jul. 6, 2007 entitled "VARIABLE CAM TIMING CONTROLS MOUNTED IN THE CAMSHAFT". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing. More particularly, the invention pertains to variable cam timing (VCT) controls mounted in the camshaft.

2. Description of Related Art

In the prior art, variable cam timing controls are either mounted separately from the camshaft, phaser, or spool valve, and/or are present in the front cover of the internal combustion engine. Positioning of the variable cam timing controls separate from the housing increases the length of the valvetrain and thus increases the engine size.

For example, in prior U.S. Pat. No. 6,571,757, a variable force solenoid for controlling the position of a center mounted spool valve within a phaser is mounted separately or externally from the phaser and the spool valve. In U.S. Pat. No. 5,201,289, the actuator of known current proportional type has a housing separate form the camshaft for moving the spool valve. In JP 04-093108A, the solenoid valve providing fluid to a center passage of the camshaft and is mounted parallel to the camshaft.

Alternatively, the variable cam timing controls are mounted in the front cover of the internal combustion engine as in U.S. Pat. No. 6,435,154.

Due to the current demand in the automotive industry for improved or smaller packaging, there is a need for moving the variable cam timing controls relative to the variable cam timing mechanism or phaser, to decrease the packaging space of the VCT system.

SUMMARY OF THE INVENTION

An internal combustion engine in which the variable cam timing controls for a variable cam timing mechanism include a variable force solenoid mounted within a hollow portion of the camshaft. The variable force solenoid is maintained in place within the hollow camshaft by a tubular shaft fixed to the engine and a bearing between the solenoid and the variable cam timing mechanism.

DETAILED DESCRIPTION OF THE INVENTION

Figure 1:
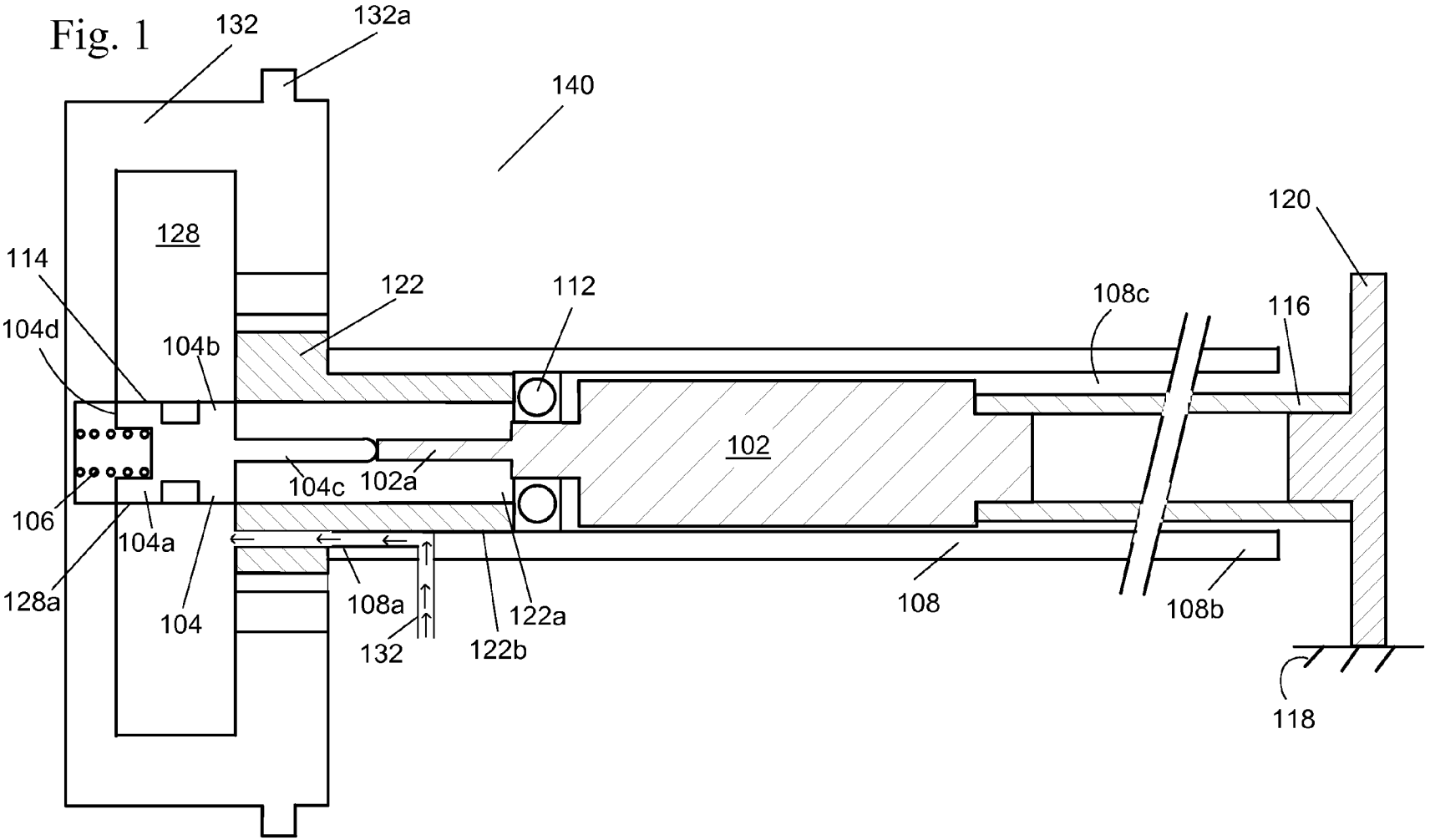
FIG. 1 shows a drawing of variable cam timing controls mounted within the camshaft.

FIG. 1 shows a drawing of the timing controls for a variable cam timing mechanism mounted within the camshaft. The VCT mechanism may use one or more "vane phasers" on the engine camshaft (or camshafts, in a multiple-camshaft engine). In most cases, the phaser has a rotor 128 with one or more vanes, mounted to a first end 108*a* of the camshaft 108, and surrounded by a housing 132 forming a chamber between the rotor and the housing in which the vanes (not shown) fit. The housing 132 of the VCT mechanism 140 includes teeth 132*a* for accepting drive force through a chain, usually from the crankshaft (not shown), or possibly from another camshaft in a multiple-cam engine. The flange 122 received by the housing 132 is mounted on the camshaft 108.

A control valve 114 is present in the rotor 128. The position of the control valve 114 is altered by the control valve actuator or variable force solenoid 102. The control valve 114 controls the flow of fluid to the vanes, which move and alter the timing of the engine. The control valve 114 is preferably a spool 104 with a plurality of lands 104*a*, 104*b* with a first end 104*d* biased by a spring 106 and a second end 104*c* for contact with an armature 102*a* of the variable force solenoid 102.

Mounted within a hollow portion of the camshaft 108 is a small diameter variable force solenoid 102 with a first end supported by a bearing 112 and a second end that is secured within the camshaft by a tubular shaft or torque tube 116 extending out the second end of the camshaft 108*b* or the end of the camshaft 108 opposite the variable cam timing mechanism 140. The torque tube or tubular shaft 116 is connected to an end piece 120. The first end of the variable force solenoid 102 is mounted near or adjacent to a bearing 112 close to the variable cam timing mechanism 140. The bearing 112 ensures the variable force solenoid's 102 radial and axial position relative to the center mounted control valve 114. The tubular shaft or torque tube 116 is secured to a mounting on the engine head or on the engine block 118 through end piece 120, preventing the variable force solenoid 102 from rotating or turning with the camshaft 108. The tubular shaft or torque tube 116 may also be used to route wiring (not shown) from the variable force solenoid 102 to a connector mounted on the engine head 118.

The hollow 122*a* of the cam flange 122, the hollow 108*c* of the camshaft 108, and the bore in which the control valve 114 is housed are all aligned. The armature 102*a* of the variable force solenoid 102 and the second end 104*c* of the spool 104 extends into the hollow portion 122*a* of the cam flange 122. The armature 102*a* of the variable force solenoid 102 contacts the second end 104*c* of the spool 104 and adjusts the position of the spool 104 within the variable cam timing mechanism 140 in proportion to a control signal received from the ECU (not shown).

Fluid enters the variable cam timing mechanism 140 through a line 132 in the camshaft 108, which extends to the rotor 128 through the cam flange 122. Fluid may enter and travel to the rotor through other pathways known in the art.

Figure 3:
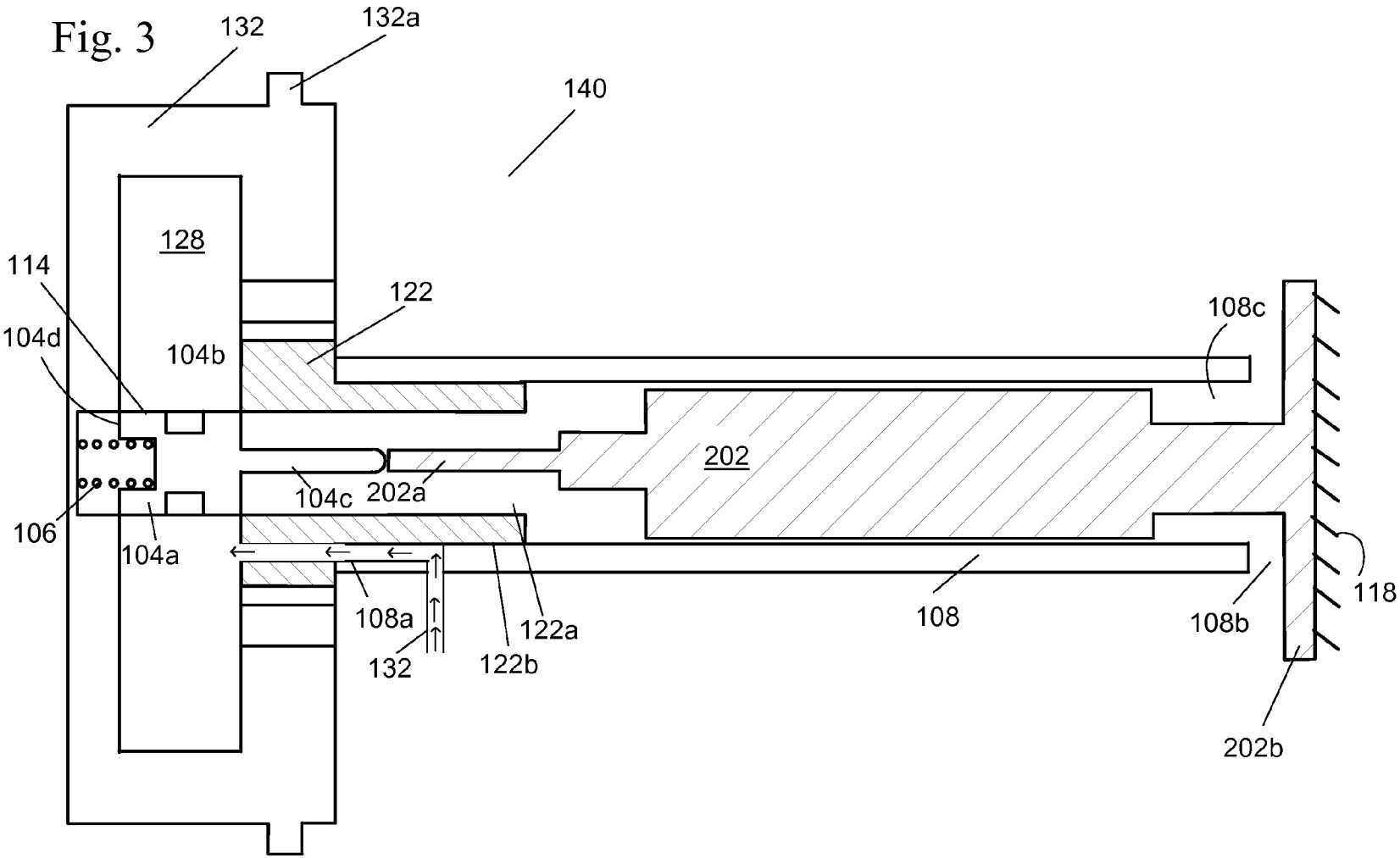
FIG. 3 shows a drawing of variable cam timing controls mounted within the camshaft of an alternate embodiment.

Alternatively, as shown in FIG. 3, the variable force solenoid 202 may be mounted within a hollow portion 108*c* of the camshaft 108 by increasing the length of the variable force solenoid 202 so that one end 202*b* of the solenoid is attached to the engine block 118 directly. By attaching an end 202*b* of the variable force solenoid 202 to the engine block 118, a bearing 112 would not be necessary.

The variable cam timing mechanism 140 may be any type of phaser with a center mounted control valve. The phaser may be a torsion assist phaser as in U.S. Pat. No. 6,883,481, issued Apr. 26, 2005, entitled "TORSIONAL ASSISTED MULTI-POSITION CAM INDEXER HAVING CONTROLS LOCATED IN ROTOR" and discloses a single check valve TA, and is herein incorporated by reference and/or U.S. Pat. No. 6,763,791, issued Jul. 20, 2004, entitled "CAM PHASER FOR ENGINES HAVING TWO CHECK VALVES IN ROTOR BETWEEN CHAMBERS AND SPOOL VALVE" discloses two check valve TA, and is herein incorporated by reference. The phaser may also be a hybrid phaser as in U.S. Pat. No. 7,255,077, issued Aug. 14, 2007, entitled, "CTA PHASER WITH PROPORTIONAL OIL PRESSURE FOR ACTUATION AT ENGINE CONDITION WITH LOW CAM TORSIONALS," and is herein incorporated by reference. The variable cam timing mechanism may also be a cam torque actuated phaser as in U.S. Pat. No. 5,107,804 issued Apr. 28, 1992, entitled "VARIABLE CAMSHAFT TIMING FOR INTERNAL COMBUSTION ENGINE" and is herein incorporated by reference. Alternatively, the phaser may be oil pressure actuated.

Figure 2A:
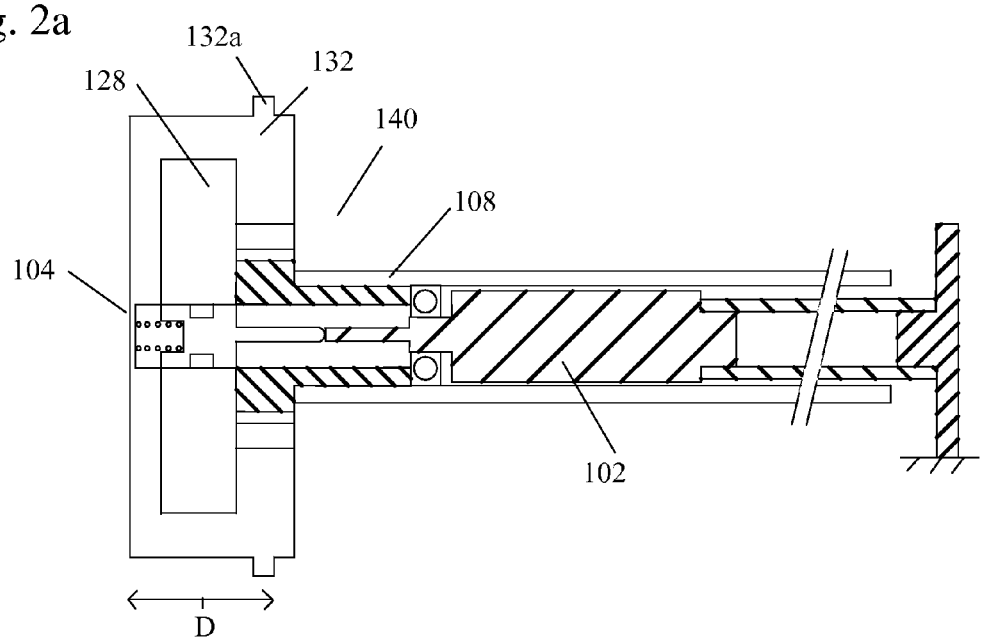
FIGS. 2*a* and 2*b* show a comparison of the length of the valvetrain and increase in engine size required by the prior art variable cam timing mechanism with the variable cam timing control separate from the housing, to the variable cam timing mechanism of the present invention with the variable cam timing controls within the camshaft.
Figure 2B:
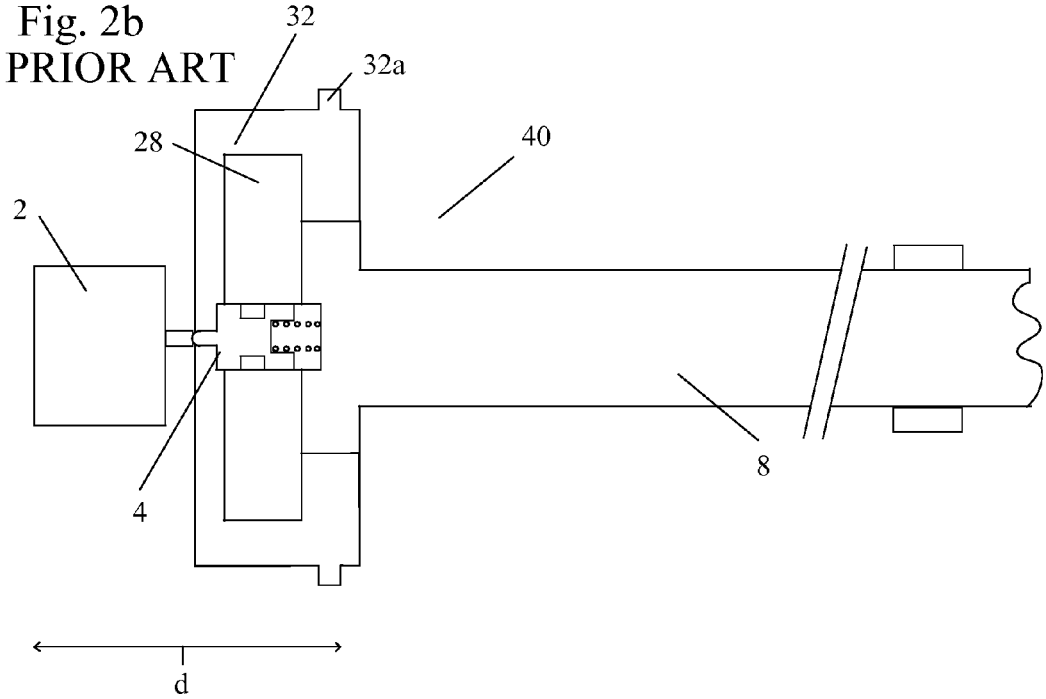
Fig. 2b PRIOR ART

FIGS. 2*a* and 2*b* show a comparison of the length of the valvetrain and increase in engine size required by the prior art variable cam timing mechanism with the variable cam timing control separate from the housing, to the variable cam timing mechanism of the present invention with the variable cam timing controls mounted within the camshaft. The teeth 132*a* on the housing 132 of the variable cam timing mechanism 140 of the present invention are aligned with the teeth 32*a* on the housing 32 of the prior art variable cam timing mechanism 40 shown in FIG. 2*b*.

FIG. 2*a* shows the variable cam timing mechanism of the present invention. The variable cam timing mechanism of the present invention has a length of D measured from the teeth 132*a* on the housing 132 to the front end of the variable cam timing mechanism.

FIG. 2*b* shows a prior art variable cam timing mechanism with the timing controls separate. The housing 32 in the prior art variable cam timing mechanism 40 surrounds a rotor 28 with one or more vanes, mounted to the camshaft 8. Within the rotor 28 is a control valve 4. The position of the control valve 4 is altered by a variable force solenoid 2 mounted outside of the mechanism 40. The prior art variable cam timing mechanism 40 has a length of d measured from the teeth 32*a* on the housing 32 to the front of the variable force solenoid necessary for controlling the variable cam timing mechanism.

As seen in comparing FIGS. 2*a* and 2*b*, the length d of the prior art mechanism 40 is significantly longer than the length D of the variable cam timing mechanism 140 of the present invention with the timing controls mounted within the camshaft.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A camshaft for an internal combustion engine comprising:

the camshaft having a first end for mounting a variable cam timing mechanism and a hollow axially within the first end; and a variable force solenoid in the hollow of the camshaft, having a first end secured to the camshaft by a bearing and a second end fixed to the engine.

2. The camshaft of claim 1, further comprising a tubular shaft connecting the second end of the variable force solenoid to the engine.

3. The camshaft of claim 1, further comprising:

a variable cam timing mechanism having a control valve, mounted to the first end of the camshaft; and the first end of the a variable force solenoid being coupled to the control valve, for altering timing of the variable cam timing mechanism.

4. The camshaft of claim 3, wherein the variable cam timing mechanism comprises: a housing for accepting drive force and a rotor mounted to the first end of the camshaft coaxially located within the housing.

5. The camshaft of claim 3, wherein the rotor of the variable cam timing mechanism is mounted to the first end of the camshaft through a cam flange.

6. The camshaft of claim 3, wherein the variable cam timing mechanism is a cam torque actuated phaser, an oil pressure actuated phaser, a torsion assist phaser, or a hybrid phaser.

* * * * *